United States Patent [19]

Imatt

[11] 4,198,0

[45] Apr. 15, 19

[54] INTERACTING GAME BOARD AND PLAYING PIECE

[75] Inventor: Alex Imatt, Chicago, Ill.

[73] Assignee: Marvin Glass & Associates, Chicago, Ill.

[21] Appl. No.: 876,408

[22] Filed: Feb. 10, 1978

[51] Int. Cl.[2] ..... A63F 3/00; A63F 3/02

[52] U.S. Cl. ..... 273/243; 273/282; 273/289; 273/260

[58] Field of Search ..... 273/266, 281, 282, 260, 273/255, 289, 243

[56] References Cited

U.S. PATENT DOCUMENTS

| | | | |
|---|---|---|---|
| 3,656,758 | 4/1972 | Thatcher | 273/289 X |
| 4,013,291 | 3/1977 | Brass et al. | 273/289 X |
| 4,083,564 | 4/1978 | Matsumoto | 273/239 |

FOREIGN PATENT DOCUMENTS

| | | | |
|---|---|---|---|
| 532758 | 2/1922 | France | 273/242 |
| 476919 | 12/1937 | United Kingdom | 273/282 |

*Primary Examiner*—Richard C. Pinkham
*Assistant Examiner*—Scott L. Brown
*Attorney, Agent, or Firm*—Mason, Kolehmainen, Rathburn & Wyss

[57] ABSTRACT

A board game type game apparatus is provided b game board having a plurality of defined stations an plurality of playing pieces which interact with the pl ing stations to indicate in which direction and for h many stations a playing piece may be moved on sub quent moves. Each playing piece includes a plurality apertures in its upper surface and a movable substr mounted below the apertures having a predetermin pattern of light and dark areas. The pattern in combi tion with the apertures determines the direction moves and the number of stations which that playi piece may be moved. The game board includes a me anism for moving the substrate relative to the apertu so that, after each move, new information may be p vided to indicate a different direction of travel a number of stations to be traversed on a subsequ move. Opposing playing pieces are captured by proper move which terminates on a station occupied an opponent's playing piece, which is then remov from play.

4 Claims, 7 Drawing Figures

Fig 3
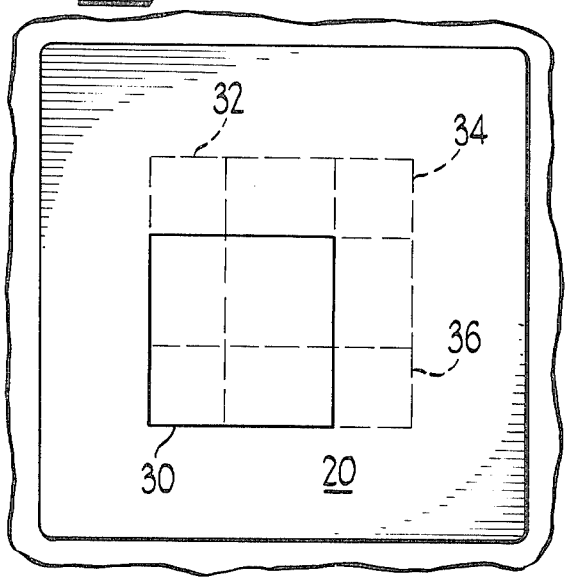
Fig 6
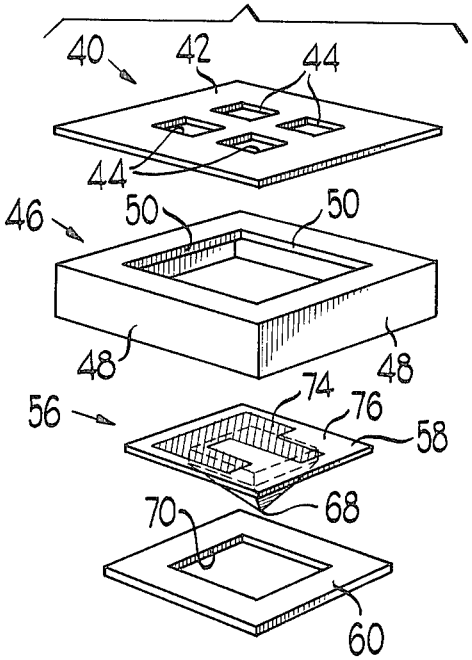
Fig 4
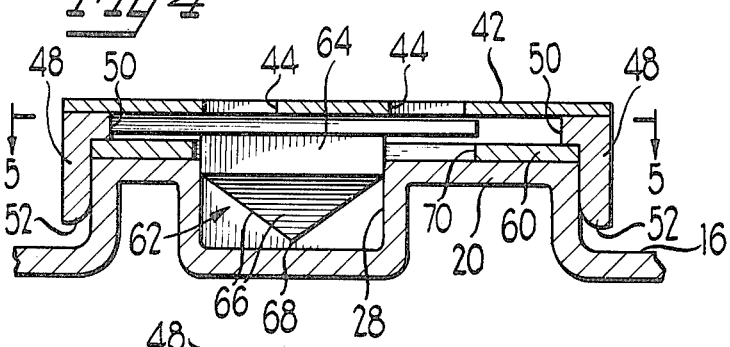
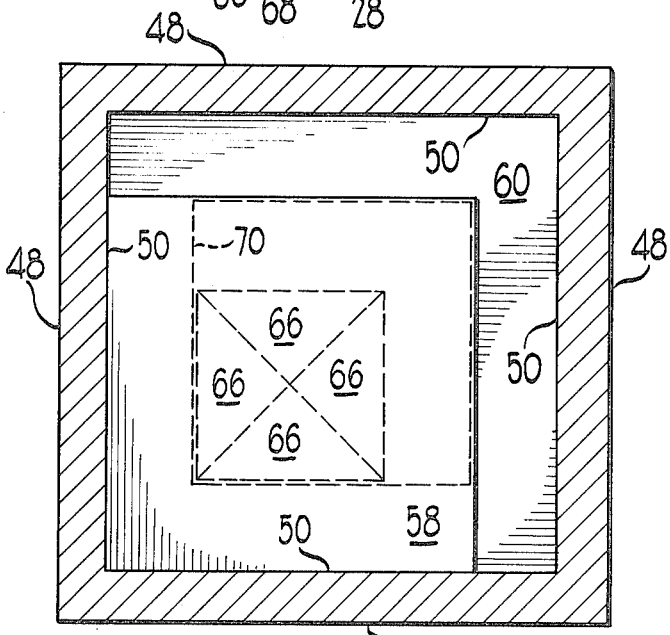
Fig 5
Fig 7
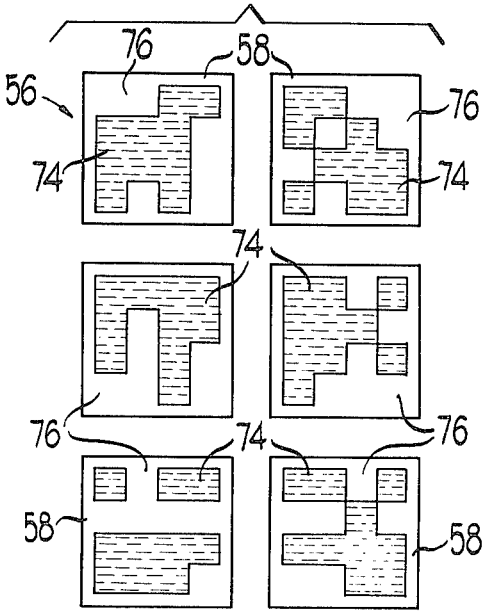

INTERACTING GAME BOARD AND PLAYING PIECE

BACKGROUND OF THE INVENTION

1. Field of the Invention

This invention is directed to a board game type apparatus in which the board interacts with the playing pieces to indicate the direction and distance of a permissible move.

2. Brief Description of the Prior Art

Many games have been provided which require participants of the game to visually observe the condition of certain game components and to react accordingly to perform a particular function. With the present invention, each playing piece cooperates with the board to determine its subsequent permissible move.

SUMMARY OF THE INVENTION

An object of the present invention is to provide a new and entertaining board game type apparatus in which subsequent moves of the playing pieces are determined by interaction with the board itself.

In accordance with the above and other objects, the present invention provides a game apparatus having a base or game board defining a playing area having a plurality of playing piece stations. A plurality of playing pieces are provided and co-act with means on the base for locating one of the playing positions on a particular station. An indicating means within each of the playing pieces is proved to indicate the next permissible move of that particular playing piece, both in its direction of travel and the number of stations in which it is permitted to be moved. A control means on each of the stations interacts with the indicating means of the particular playing piece located thereon and in most instances will vary the information provided by the indicating means.

While the present invention is susceptible of embodiment in many different forms, there is shown in the drawings and will be described in detail a specific embodiment and several modifications thereof, with the understanding that the present disclosure is to be considered as an exemplification of the principles of the invention and is not intended to limit the invention to the embodiment illustrated.

BRIEF DESCRIPTION OF THE DRAWINGS

FIG. 3 is a partially fragmented, top plan view, on an enlarged scale, of one of the playing stations showing the various possible orientations of the indicating means;

FIG. 4 is a vertical section of one of the playing pieces taken generally along line 4—4 of FIG. 1;

FIG. 5 is a horizontal section taken generally along line 5—5 of FIG. 4;

FIG. 6 is an exploded perspective view, on an enlarged scale, of one of the playing pieces; and FIG. 7 is a top plan view illustrating several of the preferred patterns utilized by the indicating means of each playing piece.

DETAILED DESCRIPTION OF THE PREFERRED EMBODIMENT

Figure 1:
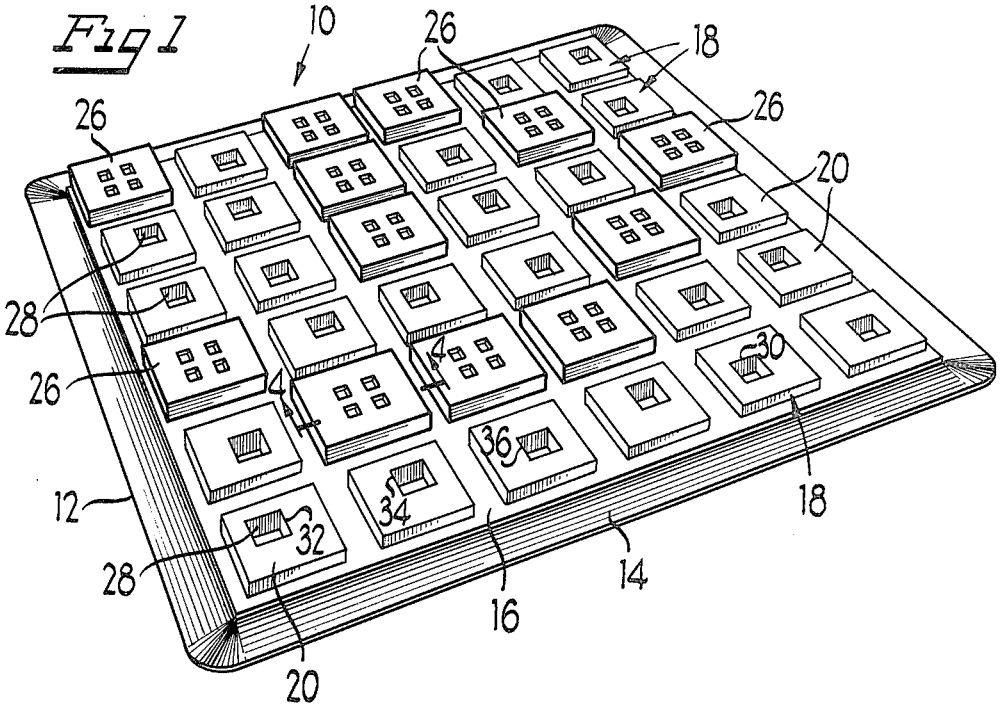
FIG. 1 is a perspective view of a preferred embodiment of the game apparatus made in accordance with the concepts of the present invention.

A game apparatus made in accordance with the concepts of the present invention is shown in FIG. 1 and generally designated by the reference numeral 10. The game apparatus 10 includes a playing board or base 12 having a peripheral rim or flange portion 14 about a raised platform 16. A six-by-six array or matrix of playing stations 18 is defined by thirty-six generally square bosses 20 mounted on the surface 16 in a spaced relation as shown in FIG. 1. The raised bosses 20 provide a locating means for one of a plurality of playing pieces 26 provided with the game.

A control means comprising an aperture or depression 28 (FIGS. 1 and 4) is provided to interact with the playing pieces to determine permissible moves of the playing pieces, as will be described in detail hereinafter. Each of the apertures or depressions 28, in the preferred embodiment, is in the shape of a square and may be located on the top surface of the boss 20 at one of four positions. Referring particularly to FIG. 3, the solid line designated 30 represents the lower lefthand corner position of an aperture 28 on a particular boss 20. In a random or predetermined manner, the aperture 28 may be located in the upper lefthand corner of the playing surface as designated by the reference numeral 32, the upper righthand corner as designated by the reference numeral 34 or the lower righthand corner as shown by the reference numeral 36. These positions are shown individually in the forwardmost row of the playing stations 18 in FIG. 1. Thus, there are four possible positions for the aperture or depression 28 in the preferred embodiment. The number of positions for the control means could vary within the concept and scope of the present invention.

A plurality of playing pieces, generally designated 40 (FIG. 6), are provided of two different color-coded sets of six each, for the players of the game. Each playing piece 40 includes a top planar surface 42 having a plurality of apertures 44 in a surface 42. In the preferred embodiment, four generally square apertures 44 are provided in each top 42 of the playing pieces. The top 42 is secured to a bottom portion 46 which provides a depending peripheral flange 48 and inner shoulder 50, as shown in FIG. 4. The peripheral flange 48 includes an interior rounded or tapered edge 52 which facilitates placement of the depending flange portion 48 over the boss 20 which serves to precisely locate a playing piece 40 thereon. A movable element, generally designated 56, provides an indicating means for identifying the permissible direction of movement of a particular playing piece as well as providing the distance or number of stations which the playing piece can be moved. The identifying means 56 includes a substrate or flat plate 58 which is mounted for movement within the playing piece below the apertures 44. The substrate 58 is slidably or movably mounted within the playing piece by a capturing bottom plate 60 which fits within the peripheral wall 48 in engagement with the shoulder 50. The substrate 58 is thus movable within the playing piece but is not rotatable because of its generally square shape. A depending locating means, generally designated 62, is secured to the bottom of the substrate 58, generally in the center thereof. The depending locater 62 comprises a generally square base portion 64 and a plurality of converging tapered walls 66 extending downwardly from the base 64 to a point 68. The locater 2 extends downwardly through a square aperture 70 in he capturing plate 60 and is movable from corner to orner of the aperture 70 to define four positions for the ubstrate 58 which coincides with the four positions efined by the apertures 30, 32, 34 and 36 on the bosses 0. Thus, placement of a playing piece on any of the osses 20 will cause the tapered surfaces 66 of the locater 62 to move the locater, if necessary, to one of the our positions as the playing piece 40 is located by its eripheral flange 48 on one of the bosses 20. As shown nd discussed above with respect to FIG. 3, since the our positions 30–36 overlap, the point 68 on the locater vill always enter the aperture 28 and, if necessary, nove the substrate 58 so that the capturing plate 60 nates with the top of one of the bosses 20. Thus, movenent of a playing piece from one boss 20 to another oss, of necessity, move the substrate 58 if the aperture 8 is in a different location. Similarly, lifting and rotatng a playing piece 40 and then relocating the playing iece on the same boss 20 will cause a similar shift in the ubstrate 58.

Referring to FIG. 7, there are shown six different orms of the indicating means 56. In the preferred emodiment, these six distinguishable patters are provided or each set of color-coded playing pieces 40. The disinguishable pattern of the indicating means 56 includes ndicia of various shapes, such as those shown in FIG. 7, ut not limited thereto, of dark areas 74 and light areas 6. The different areas 76 and 74 are proportioned acording to the size and location of the apertures 44 in he top 42 of the playing pieces so that the apertures 44 vill display the pattern therebelow. Specifically, the ocation and size of the two distinguishable areas on the ubstrates 58 are located and arranged so that at least ne of the apertures 44 will be in alignment with the ight area 76 on the substrate, regardless of the position f the substrate 58 within the playing piece. Of course, his assumes that the locater 62 is in one of its four erminal positions. The patterns on the indicating means 6 provide that two, three or four of the apertures 44 vill display a light area 76 of the pattern depending pon its particular location within the playing piece 40. Thus, when a playing piece is placed on the game board 2, one light area may appear in any of the four apertures 44. In addition, two light areas may appear in the pertures 44 in line or on a diagonal. Similarly, four ombinations of three light areas are possible and of ourse, only one possibility is available for light areas ppearing below all four apertures 44.

Figure 2:
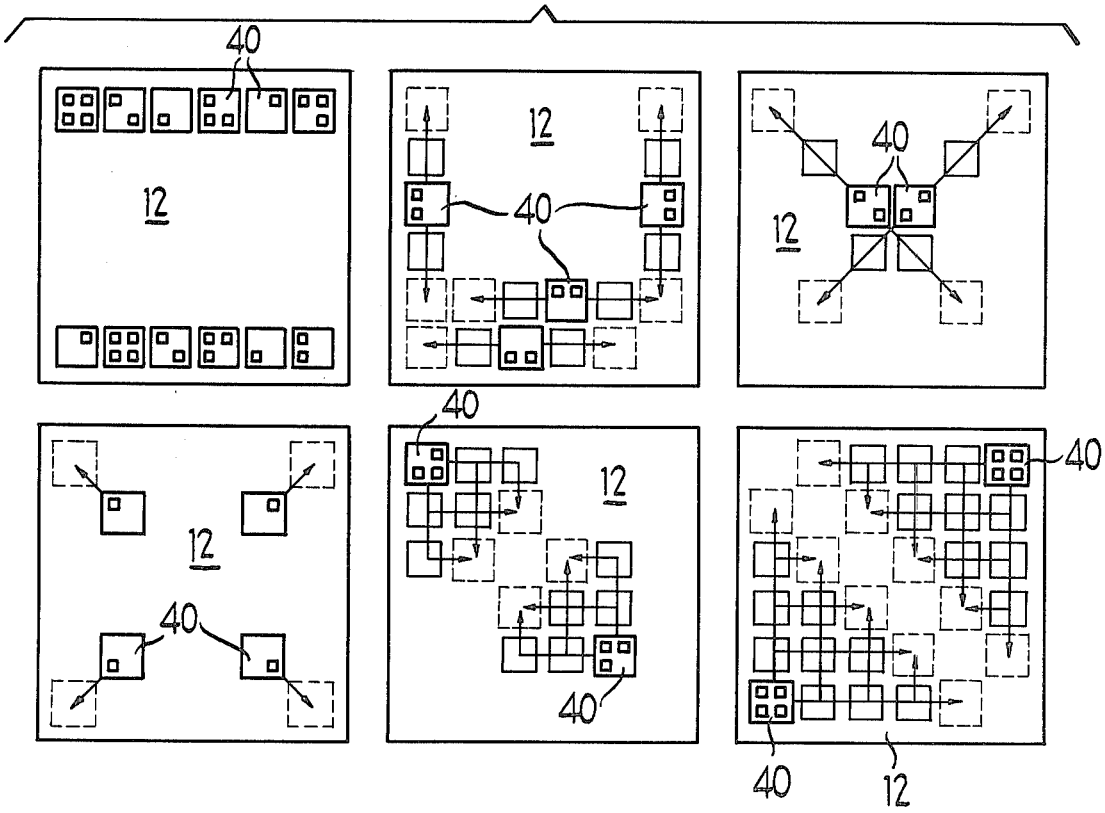
FIG. 2 is an illustrative diagram of the starting positions and the various permissible moves of the playing pieces in accordance with the indicating means.

In one scheme of play of the game, each player manully takes his six color-coded playing pieces, and ranlomly places them on the first row adjacent to himself, nd opposite from the other player. One of the players s chosen at random to be the first player to move, and he moves are made according to the following descripion, referring to FIG. 2. The top left illustration in FIG. 2 shows a typical starting position of the twelve laying pieces 40 on the board 12. For illustrative purposes, those areas representing the appearance of the attern are shown as small squares. Thus, referring to he bottom lefthand illustration, if one dot is showing, he playing piece may be moved diagonally one square n the direction closest to the dot, thus there for possible noves as shown. The top center illustration of FIG. 2 lepicts the condition where two dots are shown appearng on the same or in line orientation. In this case, the laying piece may move horizontally or vertically in ither direction along the line established by the dots, for two stations. The right top illustration shows that if two dots appear at the opposite corners of a playing piece 40 the playing piece may move diagonally, in either direction, along a line established by the dots for two stations.

The bottom center illustration shows two of the four possible conditions with three dots appearing in the apertures 44. The three dots are considered to represent the travel of direction, generally as an arrow, in the direction of the corner dot which is not matched. This condition permits the playing piece 40 to be moved two squares in one horizontal direction and then one square at a right angle or conversely one square and then two squares at a right angle. This move is identical to the move of a knight in the conventional game of chess but only in the direction indicated by the arrow provided by the three dots to the two positions as shown in phantom. Lastly, referring to the lowermost righthand illustration, with four dots or dark patterns showing. The playing piece may be moved in any horizontal or vertical direction for a total of four squares in a straight line or with one right angle turn. Thus, all the possible moves are shown in FIG. 2. At the beginning of play, referring to FIG. 2, the upper righthand playing piece, with three dots, is shown as forming an arrow pointing generally off of the board. In this case, this playing piece and the one directly adjacent thereto with one dot showing, are immovable, since they cannot move in the directions indicated. However, the game rules provide that a player may elect to rotate any one playing piece in either direction in lieu of a position move. Thus, the only way these playing pieces can be utilized is for the player to rotate them, on one of his moves.

Further, in accordance to the scheme of play provided, movement of the playing pieces can be made only over clear paths, that is to say, that the players cannot jump over their own or opponent's playing pieces during a move. Also, the playing pieces cannot be rotated in a translatory move. An opponent's playing piece is captured by a proper move which terminates on a station 18 occupied by the opponent's playing piece, which is then removed from the play of the game. When one of the players has captured five of the opponent's playing pieces, he may be declared the winner of the game.

While this embodiment has been shown and described with reference to a particular number of apertures in the playing pieces, and the rules for one scheme of play have been described in detail, obviously, many modifications and variations thereof are possible in light of the above teachings. Therefore, the foregoing detailed description has been given for clearness of understanding only and no unnecessary limitations should be understood therefrom as some modifications in the invention may be practiced other than specifically described above, within the scope of the appended claims.

I claim:

1. A game apparatus, comprising:

a base having a playing area and a plurality of stations defined thereon;

a plurality of playing pieces positionable on said stations;

movable means on said playing pieces for indicating a permissible move of the playing piece including indicia on the movable means for providing information indicative of the permissible move; and control means on the base for varying the indication of the movable means, said control means comprising an aperture on said base for engagement with said movable means to align the indicia in a predetermined position, said aperture being a polygon having a predetermined number of sides and said movable means including a three-dimensional tapered solid having a base with a similar number of sides.

2. The game apparatus of claim 1 wherein said predetermined number is four.

3. A game apparatus, comprising:

a base defining a playing area having a plurality of stations;

a plurality of playing pieces, each including a plurality of apertures, positionable on said stations;

means on said playing pieces for indicating a permissible move of the playing piece, said indicating means comprising a pyramid-shaped movable element and indicia on said movable element comprising a predetermined pattern of distinguishable areas;

said control means comprising a four-sided aperture at each of said stations for engagement with said movable element to align the distinguishable areas with the plurality of apertures in the playing piece to indicate the permissible moves.

4. A game apparatus, comprising:

a base defining a playing area having a plurality of stations;

a plurality of playing pieces, each including a top surface having a plurality of apertures therein;

means for locating one of the playing pieces on ea station;

indicating means on each of said playing pieces indicating a permissible move of the playing pie said indicating means comprising a coded moval element having indicia thereon comprising a p rality of predetermined patterns of distinguishal areas to indicate the permissible move of the pl ing piece;

control means on each of said stations for varying t indicating means of said playing piece locat thereon by said locating means, the control me being a four-sided polygon located on some of s stations at different positions relative to said loc ing means;

means depending from said movable element for gagement with said control means on said stati said depending means comprising a three-dim sional pyramid-shaped solid providing four pc tions for said movable element; and a depending peripheral means on each of said playi pieces engageable with said locating means to fa itate alignment with said playing stations to ass engagement of said control means with said pending elements whereby movement of said pl ing piece from a first station to a second station w cause a change in said indicating means if the c trol means on the respective first and second s tions is at a different relative location.

* * * * *